US009150370B2

(12) United States Patent
Ogino et al.

(10) Patent No.: US 9,150,370 B2
(45) Date of Patent: Oct. 6, 2015

(54) SHEET FEEDER AND IMAGE FORMING APPARATUS INCORPORATING SAME

(71) Applicants: Takahiro Ogino, Kanagawa (JP); Tetsuya Ofuchi, Kanagawa (JP); Yasuyuki Sekino, Kanagawa (JP); Kohtaroh Oda, Kanagawa (JP)

(72) Inventors: Takahiro Ogino, Kanagawa (JP); Tetsuya Ofuchi, Kanagawa (JP); Yasuyuki Sekino, Kanagawa (JP); Kohtaroh Oda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/521,649

(22) Filed: Oct. 23, 2014

(65) Prior Publication Data

US 2015/0115518 A1 Apr. 30, 2015

(30) Foreign Application Priority Data

Oct. 25, 2013 (JP) ..... 2013-222213

(51) Int. Cl.

| | |
|---|---|
| ***B65H 3/18*** | (2006.01) |
| ***B65H 1/04*** | (2006.01) |
| ***B65H 1/14*** | (2006.01) |
| ***B65H 3/54*** | (2006.01) |
| ***B65H 3/04*** | (2006.01) |

(52) U.S. Cl.

CPC .. *B65H 3/18* (2013.01); *B65H 1/04* (2013.01); *B65H 1/14* (2013.01); *B65H 3/04* (2013.01); *B65H 3/54* (2013.01)

(58) Field of Classification Search

CPC ..... B65H 3/18; B65H 3/54; B65H 3/66; B65H 3/04; B65H 3/047; B65H 3/0676; B65H 3/34; B65H 3/46; B65H 3/52; B65H 3/5253

USPC ..... 271/18.1, 34, 121, 123

See application file for complete search history.

(56) References Cited

U.S. PATENT DOCUMENTS

| | | | | |
|---|---|---|---|---|
| 9,004,482 | B2 * | 4/2015 | Ishikawa et al. | 271/4.05 |
| 2003/0001330 | A1 | 1/2003 | Ohfuchi | |
| 2006/0232759 | A1 | 10/2006 | Fukube et al. | |
| 2007/0138416 | A1 | 6/2007 | Ohta et al. | |
| 2008/0315496 | A1 | 12/2008 | Sekino et al. | |
| 2011/0127711 | A1 * | 6/2011 | Takahashi et al. | 271/18.1 |
| 2011/0133390 | A1 | 6/2011 | Ohfuchi | |
| 2011/0204558 | A1 * | 8/2011 | Takahashi et al. | 271/18.1 |
| 2012/0170960 | A1 * | 7/2012 | Nishida et al. | 400/629 |
| 2012/0228817 | A1 * | 9/2012 | Kobayashi et al. | 271/34 |
| 2012/0230745 | A1 | 9/2012 | Kobayashi et al. | |
| 2014/0001699 | A1 * | 1/2014 | Ishikawa et al. | 271/18.1 |
| 2014/0312557 | A1 * | 10/2014 | Ishikawa et al. | 271/18.1 |

FOREIGN PATENT DOCUMENTS

| | | |
|---|---|---|
| JP | 2012-188230 | 10/2012 |
| JP | 2012-188275 | 10/2012 |

* cited by examiner

*Primary Examiner* — David H Bollinger

(74) *Attorney, Agent, or Firm* — Harness, Dickey & Pierce, P.L.C.

(57) ABSTRACT

A sheet feeder, which is incorporated in an image forming apparatus, includes a sheet container, a sheet conveying member disposed facing a sheet stack that includes multiple sheet members loaded on the sheet container to separate an uppermost sheet member placed on the sheet stack from the other sheet members and to convey the uppermost sheet member, and a pressing member switchable between a pressing position to press the sheet stack from above and a retracted position to separate from the sheet stack.

20 Claims, 9 Drawing Sheets

SHEET FEEDER AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application No. 2013-222213, filed on Oct. 25, 2013 in the Japan Patent Office, the entire disclosure of which is hereby incorporated by reference herein.

BACKGROUND

1. Technical Field

This disclosure relates to a sheet feeder and an electrophotographic image forming apparatus incorporating the sheet feeder.

2. Related Art

Known image forming apparatuses include copiers, printers, facsimile machines, offset printers, or multifunction peripheral printers having at least two of copying, printing, facsimile, offset printing functions, and the like. Such image forming apparatuses include a sheet feeder in which a sheet conveying member separates a sheet in a sheet stack, i.e., a stack of sheets loaded in a sheet container such as a sheet tray and holds the separated sheet before conveying the sheet to image forming devices disposed downstream from the sheet container in a sheet feeding direction.

As an example of the sheet conveying member, an endless dielectric belt is used to hold an uppermost sheet placed on a sheet tray onto a belt surface by an electrostatic force so as to rotate to convey the uppermost sheet to an extreme downstream device of the downstream image forming devices.

SUMMARY

At least one aspect of this disclosure provides a sheet feeder including a sheet container, a sheet conveying member disposed facing a sheet stack that includes multiple sheet members loaded on the sheet container to separate an uppermost sheet member placed on the sheet stack from the other sheet members and to convey the uppermost sheet member, and a pressing member switchable between a pressing position to press the sheet stack from above and a retracted position to separate from the sheet stack.

Further, at least one aspect of this disclosure provides an image forming apparatus including the above-described sheet feeder and an image forming part to form an image on the sheet member. The image forming apparatus corresponds to one of a copier, a facsimile machine, a printer, an offset printing machine, or a multifunctional machine having at least two functions of the copier, the facsimile machine, the printer, and the offset printing machine.

BRIEF DESCRIPTION OF THE DRAWINGS

A more complete appreciation of the disclosure and many of the advantages thereof will be obtained as the same becomes better understood by reference to the following detailed description when considered in connection with the accompanying drawings, wherein.

DETAILED DESCRIPTION

Figure 1:
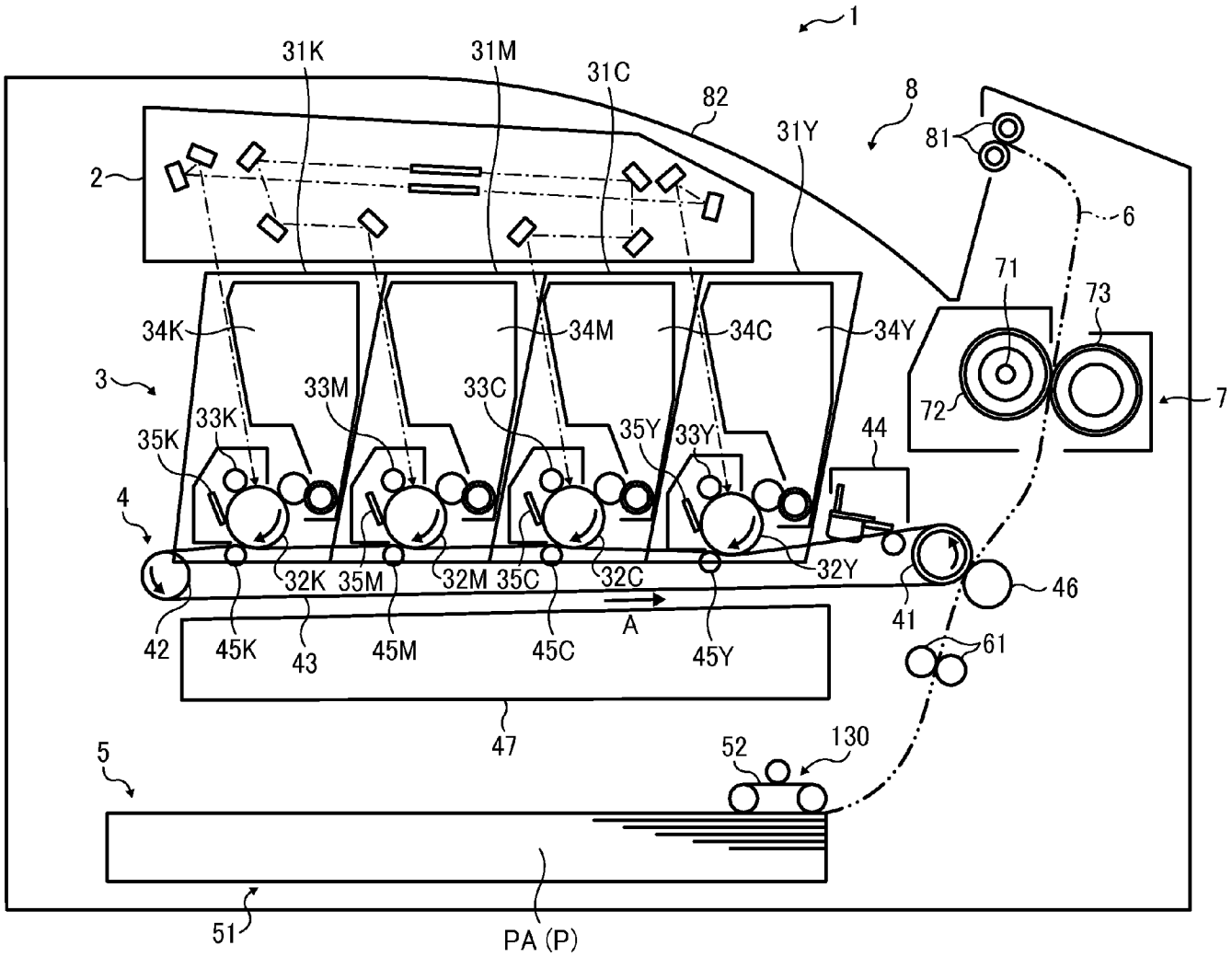
FIG. 1 is a diagram illustrating a schematic configuration of an image forming apparatus according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an image forming apparatus 1 according to an example of this disclosure.

The image forming apparatus 1 may be a copier, a facsimile machine, a printer, a plotter, a multifunction peripheral or a multifunction printer (MFP) having at least one of copying, printing, scanning, facsimile, and plotter functions, or the like. According to the present example, the image forming apparatus 1 is an electrophotographic image forming apparatus that forms color and monochrome toner images on a sheet or sheets by electrophotography.

More specifically, the image forming apparatus 1 functions as a printer. However, the image forming apparatus 1 can expand its function as a copier by adding a scanner as an option disposed on top of an apparatus body of the image forming apparatus 1. The image forming apparatus 1 can further obtain functions as a facsimile machine by adding an optional facsimile substrate in the apparatus body of the image forming apparatus 1.

Further, it is to be noted in the following examples that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, recording sheet, and recording material to which the developer or ink is attracted. In examples of this disclosure, the term "sheet" is also referred to as "sheet member".

A description is given of a configuration of the image forming apparatus 1 according to an example of this disclosure, with reference to FIG. 1.

It is to be noted that units and parts used in the image forming apparatus 1 in FIG. 1 are basically identical in each example of this disclosure. Therefore, detailed descriptions of the configuration and functions of these common units and parts are omitted or summarized and the units and parts of the image forming apparatus 1 according to examples of this disclosure may be denoted by the same reference numerals unless otherwise noted.

As illustrated in FIG. 1, the image forming apparatus 1 includes an exposure device 2, an image forming part 3, a transfer part 4, a sheet feeding device 5, a sheet conveyance path 6, a fixing device 7, and a sheet discharging part 8.

The exposure device 2 is disposed in an upper part of the image forming apparatus 1 and includes a light source to emit laser light beams and various optical components. Specifically, when obtaining image data from an image reading device such as a scanner, the exposure device 2 emits laser light beams having respective color separation elements of color images formed based on the image data to respective photoconductor drums 32Y, 32C, 32M, and 32K disposed in the image forming part 3, so as to irradiate respective surfaces of the photoconductor drums 32Y, 32C, 32M, and 32K.

The image forming part 3 is disposed below the exposure device 2 and includes multiple process units 31Y, 31C, 31M, and 31K. The multiple process units 31Y, 31C, 31M, and 31K function as image forming units and are detachably attached to the image forming apparatus 1.

Each of the multiple process units 31Y, 31C, 31M, and 31K includes a photoconductor drum 32 (i.e., photoconductor drums 32Y, 32C, 32M, and 32K), a charging roller 33 (i.e., charging rollers 33Y, 33C, 33M, and 33K), a developing device 34 (i.e., developing devices 34Y, 34C, 34M, and 34K), and a photoconductor cleaning blade 35 (i.e., photoconductor cleaning blades 35Y, 35C, 35M, and 35K). The photoconductor drum 32 carries toner that functions as developer on a surface thereof. The charging roller 33 functions as a charger to uniformly charge the surface of the photoconductor drum 32. The developing device 34 supplies the toner to the surface of the photoconductor drum 32. The photoconductor cleaning blade 35 cleans the surface of the photoconductor drum 32.

It is to be noted that the multiple process units 31Y, 31C, 31M, and 31K of the image forming apparatus 1 according to this example form yellow (Y), cyan (C), magenta (M), and black (K) toner images, respectively, which correspond to respective color separation elements of color images. Except for the different colors of toners, the multiple process units 31Y, 31C, 31M, and 31K have configurations identical to each other. Therefore, hereinafter, the units and parts included in the image forming apparatus 1 are often referred to in a singular unit without suffix indicating toner colors. For example, the multiple process units 31Y, 31C, 31M, and 31K is also referred to as "the process unit 31".

The transfer part 4 is disposed immediately below the image forming part 3. The transfer part 4 includes a drive roller 41, a driven roller 42, an intermediate transfer belt 43, a cleaning blade 44, and a primary transfer roller 45 (i.e., primary transfer rollers 45Y, 45C, 45M, and 45K). The intermediate transfer belt 43 is an endless belt that is wound around the drive roller 41 and the driven roller 42 to rotate. The cleaning blade 44 cleans an outer circumferential surface of the intermediate transfer belt 43. The primary transfer roller 45 is disposed facing the photoconductor drum 32 of the process unit 31 with the intermediate transfer belt 43 interposed therebetween. Each of the primary transfer rollers 45Y, 45C, 45M, and 45K presses an inner circumferential surface of the intermediate transfer belt 43. By so doing, a primary transfer nip region (i.e., primary transfer nip regions) is formed at a contact area of a pressed part of the intermediate transfer belt 43 and the photoconductor drum 32.

The image forming apparatus 1 further includes a secondary transfer roller 46 and a waste toner box 47.

The secondary transfer roller 46 is disposed facing the drive roller 41 with the intermediate transfer belt 43 interposed therebetween. The secondary transfer roller 46 presses an outer circumferential surface of the intermediate transfer belt 43. By so doing, a secondary transfer nip region is formed at a contact area of a pressed part of the intermediate transfer belt 43 and the secondary transfer roller 46.

The waste toner box 47 is disposed below the intermediate transfer belt 43 via a waste toner transport hose. The waste toner box 47 stores waste toner collected by the cleaning blade 44 when cleaning the surface of the intermediate transfer belt 43.

The sheet feeding device 5 functions as a sheet feeder. The sheet feeding device 5 is disposed at a lower part of the image forming apparatus 1 and includes a sheet tray 51 and an attraction belt 52. The sheet tray 51 functions as a sheet container to accommodate a sheet stack PA of sheet members including a sheet member P (for example, an uppermost sheet P1 and a subsequent sheet P2) as a sheet member. The attraction belt 52 functions as a sheet conveying member to convey the sheet member P from the sheet tray 51. Any sheet member of the sheet stack PA can be the sheet member P and a sheet member placed on top of the sheet stack PA is referred to as the uppermost sheet P1 and a sheet member immediately under the uppermost sheet P1 is referred to as the subsequent sheet P2.

The sheet conveyance path 6 is a sheet conveying path to convey the sheet member P fed from the sheet feeding device 5. Multiple sheet conveying roller pairs including a registration roller pair 61 are disposed along the sheet conveyance path 6 to the sheet discharging part 8.

The fixing device 7 includes a heater 71, a fixing roller 72, and a pressure roller 73. The fixing roller 72 is heated by the heater 71. The pressure roller 73 presses the fixing roller 72.

The sheet discharging part 8 is provided at an extreme downstream side of the sheet conveyance path 6 of the image forming apparatus 1. The sheet discharging part 8 includes a sheet discharging roller pair 81 and a sheet discharging tray 82. The sheet discharging roller pair 81 includes two rollers to discharge the sheet member P to an outside of the image forming apparatus 1. The sheet discharging tray 82 stocks the sheet member P discharged by the sheet discharging roller pair 81.

Now, a description is given of basic image forming operations of the image forming apparatus 1 with reference to FIG. 1.

When the image forming operations start in the image forming apparatus 1, respective electrostatic latent images are formed on the respective surfaces of the photoconductor drums 32Y, 32C, 32M, and 32K of the multiple process units 31Y, 31C, 31M, and 31K. The exposure device 2 emits image data of respective single color images of a desired full-color image separated to yellow, cyan, magenta, and black. The developing devices 34Y, 34C, 34M, and 34K supply the toner to the respective electrostatic latent images formed on the photoconductor drums 32Y, 32C, 32M, and 32K, so as to develop the respective electrostatic latent images into visible toner images.

Then, the drive roller 41 of the transfer part 4 rotates counterclockwise in FIG. 1, so that the intermediate transfer belt 43 moves in a direction indicated by arrow A in FIG. 1. The primary transfer roller 45 (i.e., the primary transfer rollers 45Y, 45C, 45M, and 45K) is supplied with a voltage under constant volume control or constant current control to an opposite polarity to a toner charge polarity. As a result of this supply of the voltage to the primary transfer roller 45, an electric field is formed in a transfer nip region between the primary transfer roller 45 and the photoconductor drum 32. Thereafter, respective single color toner images formed on the photoconductor drums 32Y, 32C, 32M, and 32K of the process units 31Y, 31C, 31M, and 31K are sequentially overlaid on a surface of the intermediate transfer belt 43 in the electric field in the transfer nip region. Accordingly, a full-color toner image is formed on the surface of the intermediate transfer belt 43.

By contrast, when the image forming operations start, the sheet member P that is accommodated in the sheet tray 51 of the sheet feeding device 5 at the lower part of the image forming apparatus 1 is attracted from the sheet tray 51 to the attraction belt 52 by the attraction belt 52 and fed to the sheet conveyance path 6. The registration roller pair 61 adjusts a timing of conveyance of the sheet member P traveling in the sheet conveyance path 6 toward the secondary transfer nip region formed between the secondary transfer roller 46 and the drive roller 41 that is disposed facing the secondary transfer roller 46. At this time, the transfer voltage having the opposite polarity to the toner charge polarity is applied to the secondary transfer roller 46. By so doing, an electric field in the transfer nip region is formed in the secondary transfer nip region. Then, due to the electric field in formed the secondary transfer nip region, the full-color toner image formed on the surface of the intermediate transfer belt 43 is transferred onto the sheet member P.

The sheet member P with the full-color toner image thereon is conveyed to the fixing device 7. In the fixing device 7, the fixing roller 72 that is heated by the heater 71 and the pressure roller 73 apply heat and pressure to the sheet member P, so that the full-color toner image is fixed to the sheet member P. Then, the sheet member P having the fixed full-color toner image is separated from the fixing roller 72 and is further conveyed by the multiple sheet conveying roller pairs. In the sheet discharging part 8, the sheet member P is discharged to the sheet discharging tray 82 by the sheet discharging roller pair 81.

Residual toner remaining on the surface of the intermediate transfer belt 43 after completion of second transfer of the full-color toner image is removed by the cleaning blade 44 and the like. The removed residual toner is conveyed to the waste toner box 47 by a screw and the waste toner transport hose.

The above-described image forming operations are performed when a full-color image is formed on the sheet member P. However, the image forming operations performed by the image forming apparatus 1 are not limited thereto. For example, any one of the multiple process units 31Y, 31C, 31M, and 31K is used to form a monochrome image or any two or three of the multiple process units 31Y, 31C, 31M, and 31K are used to form a two-color image or a three-color image.

Figure 2A:
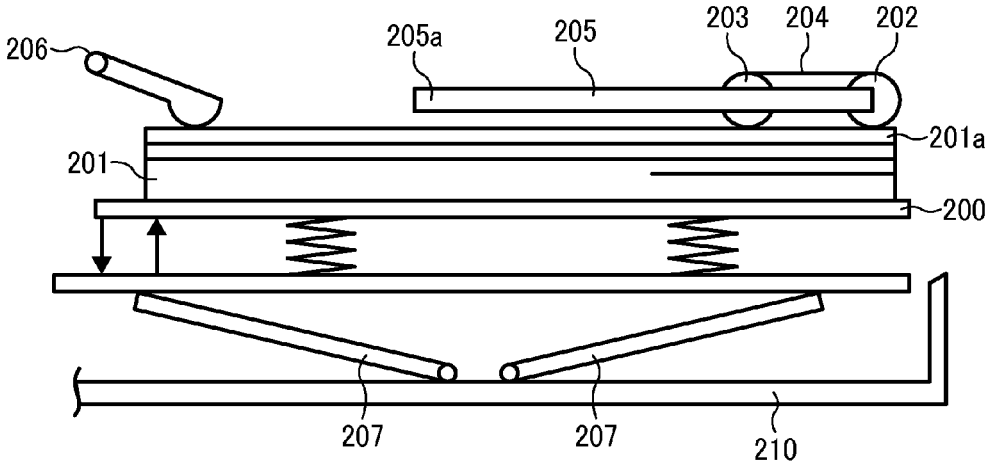
FIGS. 2A and 2B are diagrams illustrating a comparative configuration of a sheet feeder included in an image forming apparatus according to a comparative example of this disclosure.

A comparative example of a sheet conveying device shows in FIG. 2A that a sheet stack 201 is loaded on a first bottom plate 200 provided on a sheet tray 210. An attraction belt 204 is disposed in contact with a top of the sheet stack 201. The attraction belt 204 is wound around a downstream roller 202 and an upstream roller 203. The downstream roller 202 is fixed to a unit bracket 205. The attraction belt 204 is charged by a charger to attract an uppermost sheet 201*a* by an electrostatic force and hold the uppermost sheet 201*a* onto a surface of the attraction belt 204.

Figure 2B:
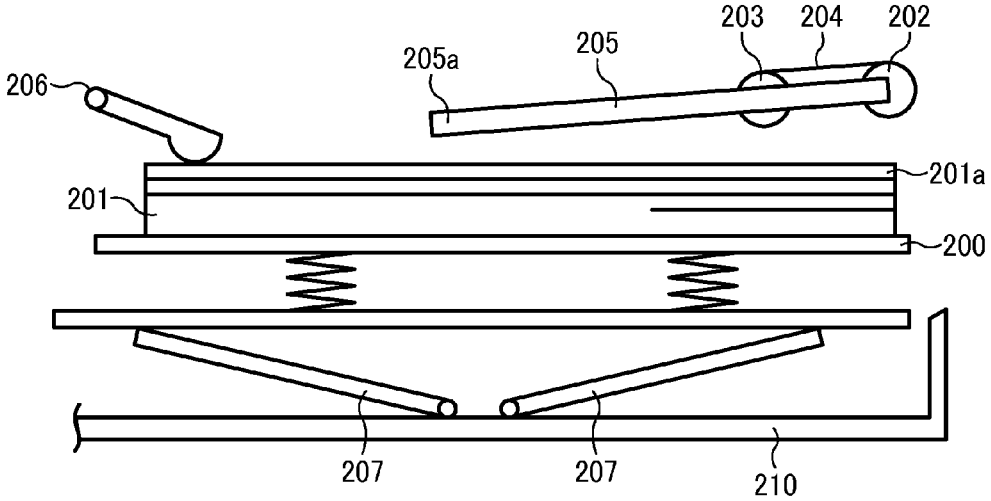

As illustrated in FIG. 2B, rotation of the unit bracket 205 about a supporting point 205*a* moves the downstream roller 202 upward. By so doing, the uppermost sheet 201*a* that is attracted to the surface of the attraction belt 204 separates from the sheet stack 201 due to curvature. Then, the uppermost sheet 201*a* is conveyed on the attraction belt 204 along with rotation of the attraction belt 204 to a sheet feed roller pair that is a further downstream image forming devices.

After the uppermost sheet 201*a* is fed to the downstream image forming devices, the attraction belt 204 moves from a rising position illustrated in FIG. 2B to a lowering position illustrated in FIG. 2A, so as to be ready for a subsequent sheet feeding operation. At this time, a detection sensor 206 that is disposed above the sheet stack 201 detects whether or not the sheet stack 201 is at a position where the attraction belt 204 contacts the sheet stack 201 when the attraction belt 204 is lowered. Then, if the sheet stack 201 is at a position lower than the position where the attraction belt 204 contacts the sheet stack 201, elevation members 207 lift the first bottom plate 200 so that the attraction belt 204 contacts the sheet stack 201 properly.

According to this configuration, an appropriate positional relation of the attraction belt 204 and the sheet stack 201 is defined. With the attraction belt 204 reciprocating the lowering position and the rising position, sheet members of the sheet stack 201 can be fed one by one to the downstream image forming devices.

In this configuration, the sheet stack 201 and the attraction belt 204 are arranged to contact each other in respective appropriate manners. However, if the uppermost sheet 201*a* of the sheet stack 201 has waves or a leading edge of the uppermost sheet 201*a* is curled, various inconveniences occur. Specifically, the uppermost sheet 201*a* does not attach to the attraction belt 204, multi-feeding occurs when the uppermost sheet 201*a* and a subsequent sheet that is placed immediately below the uppermost sheet 201*a* are not separated, and/or the sheet of the sheet stack 201 is not attracted on the surface of the attraction belt 204. As a result, the sheet is jammed at a sheet conveying part on the downstream side.

Figure 3:
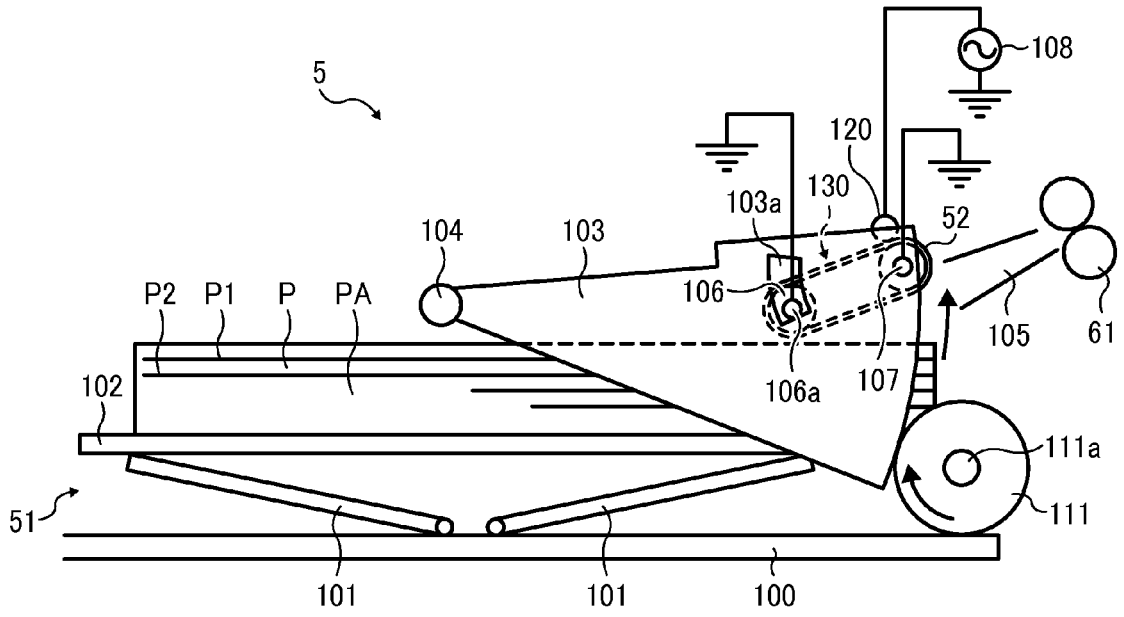
FIG. 3 is a diagram illustrating a schematic configuration of a sheet feeder included in the image forming apparatus of FIG. 1.

Now, a description is given of the sheet feeding device 5 with reference to FIG. 3.

FIG. 3 is a diagram illustrating a schematic configuration of the sheet feeding device 5 included in the image forming apparatus 1 of FIG. 1.

The sheet tray 51 accommodates the sheet stack PA of sheet members including the sheet member P. The sheet tray 51 includes a base 100, elevation arms 101, and a bottom plate 102, and the like. The bottom plate 102 is disposed above the base 100 with the elevation arms 101 arranged therebetween. The sheet stack PA is loaded on the bottom plate 102. With the elevation arms 101 extended and retracted, the sheet stack PA placed on the bottom plate 102 is elevated and lowered in a vertical direction as illustrated in FIG. 3.

Swing members 103 are disposed above the sheet stack PA in the sheet feeding device 5 of FIG. 3. Each of the swing members 103 includes a swing supporting point 104 and a slot 103*a*. Drive gears 111 that rotate about a drive shaft 111*a* are disposed on a lower right side of the swing members 103 in FIG. 3. Each of the swing members 103 is in contact with the drive gear 111, so that a driving force is transmitted from the drive gear 111 to each of the swing member 103. According to this transmission of the driving force, each swing member 103 rotates about the swing supporting point 104. An attraction/separation unit 130 is disposed on an opposite side of each swing member 103, which cannot be seen from top of FIG. 3. The attraction/separation unit 130 includes a sheet feeding drive roller 106 having a shaft 106*a* and a sheet feeding driven roller 107 having a shaft 107*a*. The registration roller pair 61 is disposed on the right side of the attraction/separation unit 130. The sheet member P that is attracted and separated by the attraction/separation unit 130 is conveyed via guide plates 105. The respective swing members 103 are disposed at both axial ends (inward and outward of the drawing sheet) of the attraction/separation unit 130. Each of the drive gears 111 contacts the swing members 103. The drive gears 111 are fixed to the single drive shaft 111*a* and rotates together.

The slot 103*a* is formed on each swing member 103. The shaft 106*a* of the sheet feeding drive roller 106 is inserted into the slot 103*a*, by which the shaft 106*a* is rotatably supported to the swing members 103 to move along the slots 103*a*. By contrast, the shaft 107*a* of the sheet feeding driven roller 107 is inserted into a different slot formed on each swing member 103, by which the shaft 107*a* is fixedly held.

Figure 4A:
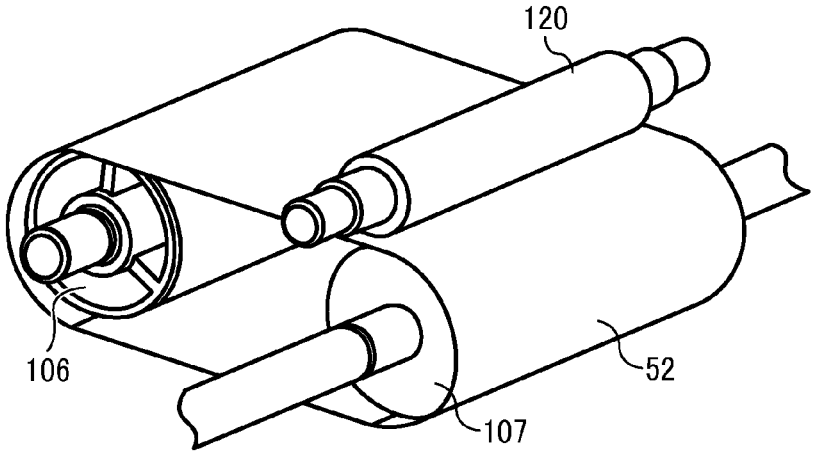
FIG. 4A is a perspective view illustrating an attraction/separation unit with a charging roller functioning as a charger.
Figure 4B:
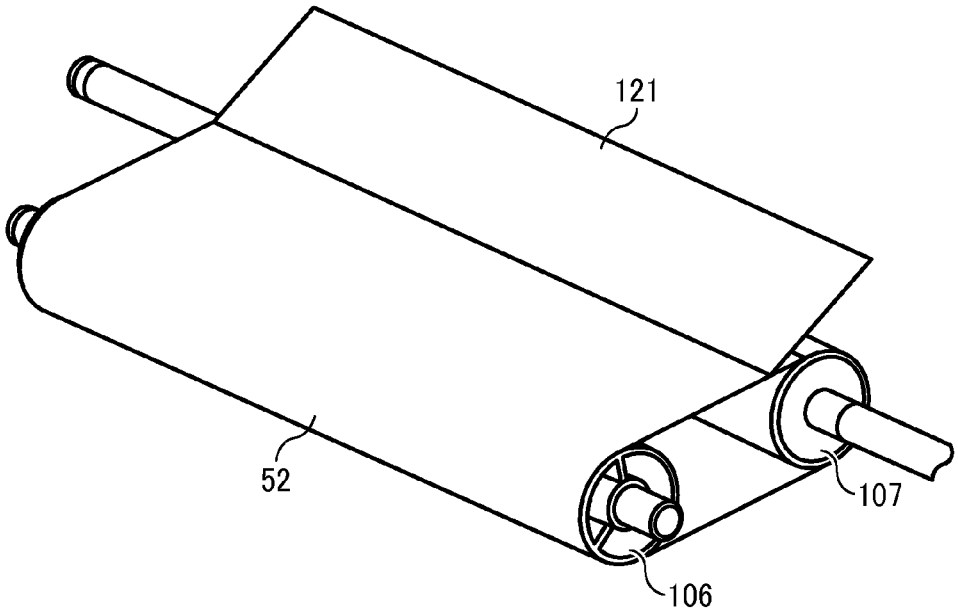
FIG. 4B is a perspective view illustrating an attraction/separation unit with a charging blade functioning as a charger.

FIG. 4A is a perspective view illustrating the attraction/separation unit 130 with a belt charging roller 120 that functions as a charger. FIG. 4B is a perspective view illustrating the attraction/separation unit 130 with a belt charging blade 121 that functions as a charger.

The attraction/separation unit 130 illustrated in FIG. 4A includes the attraction belt 52, the sheet feeding drive roller 106, the sheet feeding driven roller 107, and the belt charging roller 120.

The attraction belt 52 is an endless belt having a dielectric body and is wound around and stretched by the sheet feeding drive roller 106 and the sheet feeding driven roller 107. Upon issuance of a sheet feeding signal from the image forming apparatus 1, a drive unit applies a driving force to the sheet feeding drive roller 106 to rotate. As the sheet feeding drive roller 106 rotates, the attraction belt 52 receives the driving force so as to start its rotation. The sheet feeding driven roller 107 receives the driving force from the sheet feeding drive roller 106 via the attraction belt 52, so as to rotate with the sheet feeding drive roller 106.

The belt charging roller 120 contacts the attraction belt 52. The belt charging roller 120 is connected to an alternating-current power supply 108 as illustrated in FIG. 3. The alternating-current power supply 108 charges the attraction belt 52 via the belt charging roller 120. The charged attraction belt 52 attracts the uppermost sheet P1 of the sheet members of the sheet stack PA and conveys the sheet members one by one to downstream image forming devices. The sheet feeding drive roller 106, the sheet feeding driven roller 107, and the alternating-current power supply 108 are electrically grounded.

The attraction belt 52 has a multilayer construction that includes a front surface layer and a back surface layer. The front surface layer of the attraction belt 52 is a polyethylene terephthalate film having a thickness of about 50 μm and has a resistivity of $10^8$ Ω·cm minimum. The back surface layer of the attraction belt 52 is made of aluminum-deposited dielectric material having a resistivity of $10^6$ Ω·cm maximum. With the above-described multilayer construction of the attraction belt 52, the dielectric layer (i.e., the back layer) of the attraction belt 52 can be used as a grounded opposite electrode, and the belt charging roller 120 to apply electrical charge to the attraction belt 52 can be disposed at any position that contacts the front surface layer of the attraction belt 52. The sheet feeding driven roller 107 has a conductive rubber layer as a front surface layer having a resistivity of about $10^6$ Ω·cm. The sheet feeding drive roller 106 is a metallic roller.

In the above description with reference to FIG. 4A, the belt charging roller 120 is used as the charger. However, instead of the belt charging roller 120, the belt charging blade 121 can be used as the charger as illustrated in FIG. 4B to achieve the same effect.

Figure 5A:
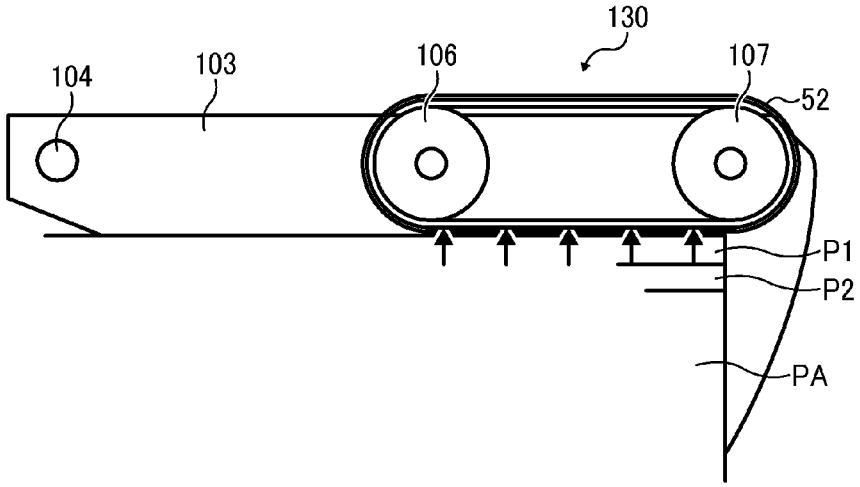
FIG. 5A is a diagram illustrating the attraction/separation unit that performs a sheet feeding operation at a sheet attraction position.
Figure 5B:
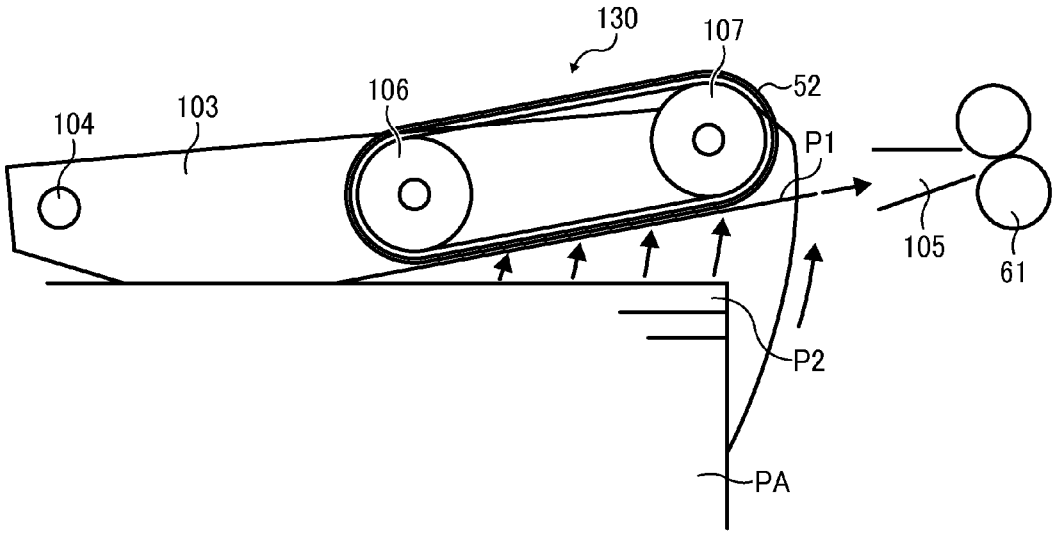
FIG. 5B is a diagram illustrating the attraction/separation unit that performs the sheet feeding operation at a sheet feeding position.

FIG. 5A is a diagram illustrating the attraction/separation unit 130 at a sheet attraction position where the sheet member P, i.e., the uppermost sheet P1 is attracted. FIG. 5B is a diagram illustrating the attraction/separation unit 130 at a sheet feeding position where the sheet member P, i.e., the uppermost sheet P1 is fed to a downstream image forming device.

In FIG. 5A, the attraction/separation unit 130 is located at the sheet attraction position and is disposed horizontally in contact with the uppermost sheet P1 of the sheet stack PA. The charged attraction belt 52 attracts the uppermost sheet P1 due to electrostatic attraction.

After the uppermost sheet P1 is attracted to the attraction/separation unit 130, the drive gear 111 transmits a driving force to the swing member 103, so that each swing member 103 rotates about the swing supporting point 104. The attraction/separation unit 130 is fixed to the swing members 103 and swings along with rotation of the swing members 103.

As illustrated in FIG. 5B, as the swing members 103 rotate counterclockwise, the attraction/separation unit 130 moves upward. With being separated from the sheet stack PA, the attraction/separation unit 130 is inclined to a horizontal direction to be at the sheet feeding position. Along with this separation of the attraction/separation unit 130 from the sheet stack PA, the uppermost sheet P1 that is attracted to the attraction/separation unit 130 separates from the sheet stack PA.

After the attraction/separation unit 130 has separated from the sheet stack PA, the sheet feeding drive roller 106 transmits a driving force to the attraction belt 52, so that the attraction belt 52 starts rotating. With this rotation of the attraction belt 52, the uppermost sheet P1 is conveyed in a sheet feeding direction to the registration roller pair 61 that is disposed downstream from the attraction belt 52 and to the further downstream image forming devices.

After feeding the attracted sheet member P, i.e., the uppermost sheet P1 to the downstream image forming device, the attraction/separation unit 130 returns to the sheet attraction position again as the swing member 103 rotates, and attracts a subsequent sheet member P, i.e., the subsequent sheet P2 from the sheet stack PA. Thus, the attraction/separation unit 130 is switchable between the sheet attraction position and the sheet feeding position along with rotation of the swing members 103.

The sheet feeding driven roller 107 has a small diameter to be suitable for separating the sheet member P from the attraction belt 52 due to curvature. Specifically, by reducing the diameter of the sheet feeding driven roller 107 to increase the curvature, the sheet member P that is attracted and conveyed by the attraction belt 52 separates from the sheet feeding driven roller 107 to be conveyed to the guide plates 105 that are disposed downstream from the sheet feeding driven roller 107 in the sheet feeding direction.

A description is given of a configuration of the sheet feeding device 5 according to an example of this disclosure with reference to FIGS. 6A, 6B, 6C, 7A, and 7B.

Figure 6B:
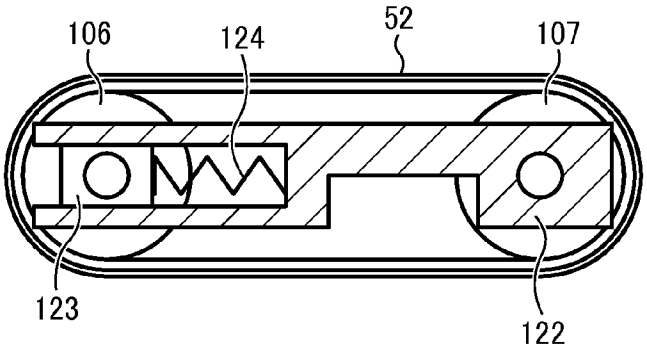
FIG. 6B is a cross sectional view illustrating the attraction/separation unit along a line A-A' of FIG. 6A.
Figure 6C:
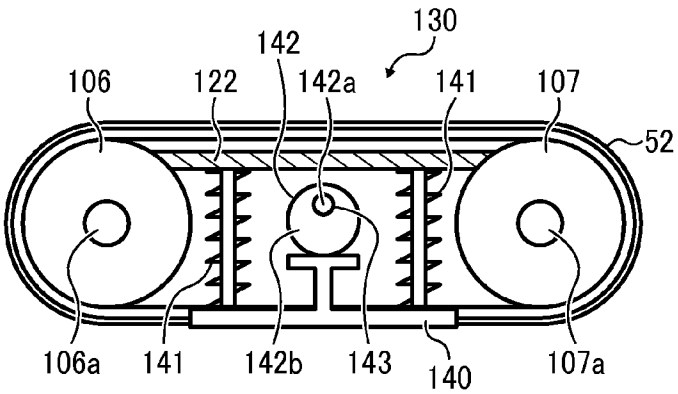
FIG. 6C is a cross sectional view illustrating the attraction/separation unit along a line B-B' of FIG. 6A.
Figure 6A:
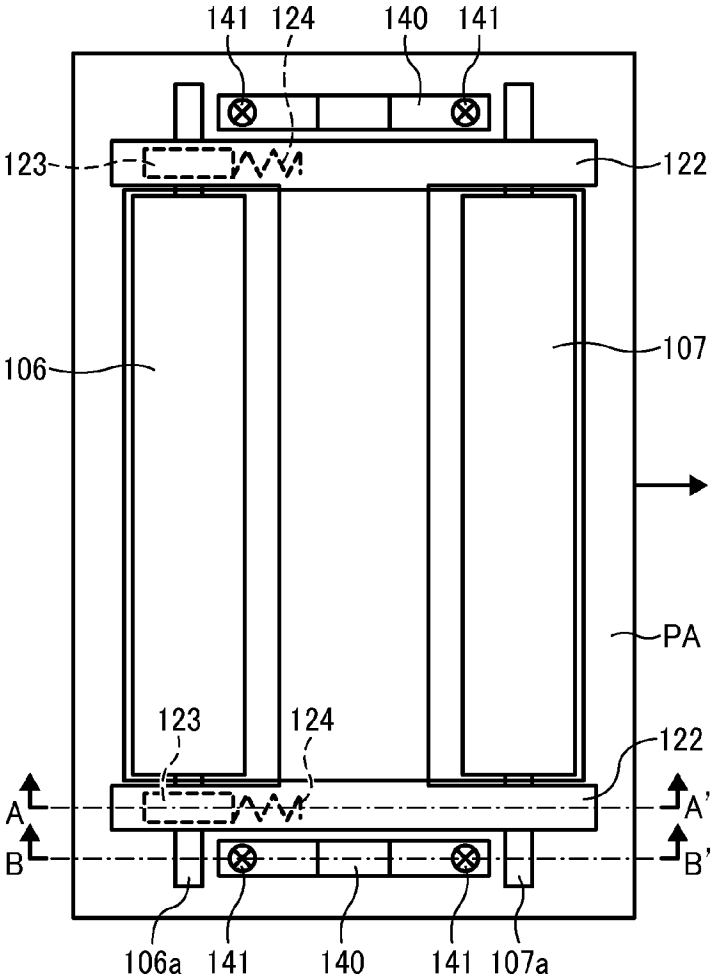
FIG. 6A is a top view illustrating the attraction/separation unit of the sheet feeder according to an example of this disclosure.

FIG. 6A is a top view illustrating a configuration of the attraction/separation unit 130 of the sheet feeding device 5 of this example.

As previously described, the sheet feeding drive roller 106 includes the shaft 106*a* and the sheet feeding driven roller 107 includes the shaft 107*a*. A housing 122 supports both axial ends of the shaft 106*a* of the sheet feeding drive roller 106 and both axial ends of the shaft 107*a* of the sheet feeding driven roller 107. Respective bearings 123 are provided at both axial ends of the sheet feeding drive roller 106 supported by the housing 122. Each of the bearings 123 includes a spring 124.

FIG. 6B is a cross sectional view illustrating the attraction/separation unit 130 along a line A-A' of FIG. 6A.

As illustrated in FIG. 6B, the shaft 107*a* of the sheet feeding driven roller 107 is rotatably supported with respect to the housing 122. The shaft 106*a* of the sheet feeding drive roller 106 is supported by the bearings 123 that is slidably supported in a sheet conveying direction with respect to the housing 122. Each of the bearings 123 is biased by the spring 124 toward an upstream side in the sheet conveying direction, which is the left side of the drawing. According to this configuration, the sheet feeding drive roller 106 biases the attraction belt 52 toward the upstream side in the sheet conveying direction, so as to apply a tension force to the attraction belt 52.

Respective pressing members 140 are provided at both lateral ends of the sheet member P in both outside areas in a width direction of the sheet feeding drive roller 106, the sheet feeding driven roller 107, and the housing 122, which is a vertical direction in FIG. 6A and an orthogonal direction to the sheet conveying direction. Each of the pressing members 140 has a substantially lateral H-section.

Elastic members 141, each of which functioning as an elastic biasing member, are provided at both longitudinal ends of each of the pressing members 140.

FIG. 6C is a cross sectional view illustrating the attraction/separation unit 130 along a line B-B' of FIG. 6A.

As illustrated in FIG. 6C, an eccentric cam 142 functions as a drive transmission unit and includes a rotation center 142*a* and a large diameter part 142*b*. The eccentric cam 142 is disposed on each of the pressing members 140 to receive a driving force applied by a motor 143 that functions as a drive unit. By so doing, the eccentric cam 142 rotates about the rotation center 142*a*. As illustrated in FIG. 6C, the large diameter part 142*b* of the eccentric cam 142 comes to a lower part of the eccentric cam 142, so as to press each pressing member 140 downwardly. Further, the pressing member 140 is attached to the housing 122 via the elastic member 141. By so doing, the pressing member 140 is biased by the elastic member 141 toward the housing 122.

Figure 7A:
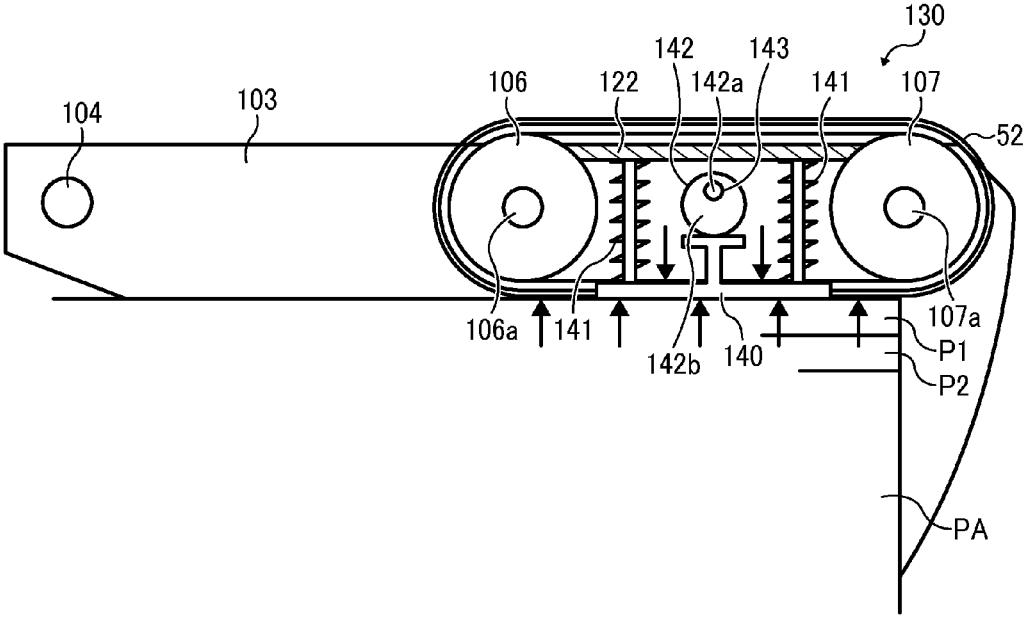
FIG. 7A is a diagram illustrating a state in which a pressing member during the sheet feeding operation when the attraction/separation unit is at the sheet attraction position.

FIG. 7A is a diagram illustrating the pressing member 140 during the sheet feeding operation when the attraction/separation unit 130 is at the sheet attraction position to attract the sheet member P from the sheet stack PA.

As illustrated in FIG. 7A, when the attraction/separation unit 130 is at the sheet attraction position, the large diameter part 142*b* of the eccentric cam 142 comes to the lower part of the eccentric cam 142, so as to press the pressing member 140 downwardly. The pressing member 140 moves to a pressing position to contact and press the uppermost sheet P1 of the sheet members of the sheet stack PA downwardly.

Due to the above-described action, even if the uppermost sheet P1 has waves or is curled at the leading end thereof, the uppermost sheet P1 is flatted due to the pressure applied by the pressing member 140 from above and can be fed to the downstream image forming devices reliably.

As illustrated in FIG. 6A, each of the pressing members 140 is provided in one of both outside areas of the sheet feeding drive roller 106 and the sheet feeding driven roller 107, which is one of both outside areas in the width direction of the attraction belt 52, and facing a corresponding one of both lateral ends of the sheet member P. The pressing members 140 press both lateral ends of the sheet member P at the pressing position to eliminate waves and/or curl(s) of the sheet member P.

Figure 7B:
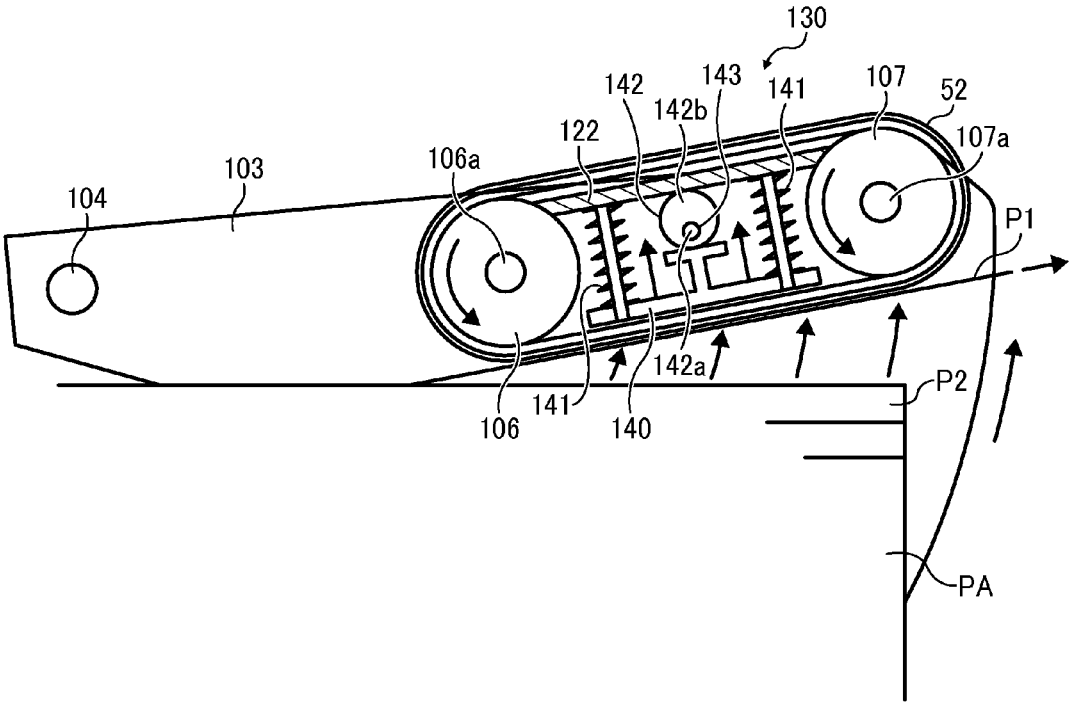
FIG. 7B is a diagram illustrating a state in which the pressing member during the sheet feeding operation when the attraction/separation unit is at the sheet feeding position.

FIG. 7B is a diagram illustrating a state in which the uppermost sheet P1 is fed by any one of the pressing members 140 during the sheet feeding operation when the attraction/separation unit 130 is at the sheet conveyance position where the sheet member P separated from the sheet stack PA is fed to the downstream image forming devices.

When the uppermost sheet P1 is attracted to the attraction belt 52, the attraction/separation unit 130 separates from the sheet stack PA to move to the sheet feeding position and feed the attracted uppermost sheet P1 to the downstream image forming devices. At this time, rotation of the motor 143 rotates the eccentric cam 142. As the eccentric cam 142 rotates, the large diameter part 142*b* moves to an upper part of the eccentric cam 142. As a result, the eccentric cam 142 no longer press the pressing member 140 downwardly. When the downward pressure to the pressing member 140 by the eccentric cam 142 is eliminated, the pressing member 140 is moved toward the housing 122 due to a biasing force applied by the elastic member 141, and therefore is separated from the sheet stack PA. This position or state in which the pressing member 140 is separated from the sheet stack PA and the downward pressure thereto is eliminated is referred to as a retracted position of the pressing member 140.

During a period after the attraction/separation unit 130 is separated from the sheet stack PA and before the attraction/separation unit 130 is moved from the sheet attraction position to the sheet feeding position, the pressing member 140 is switched from the pressing position as illustrated in FIG. 7A to the retracted position as illustrated in FIG. 7B. Accordingly, the pressing member 140 moves upward and downward by rotation of the eccentric cam 142 and switches between the pressing position and the retracted position.

Since the elastic member 141 biases the pressing member 140 toward the retracted position, i.e., the housing 122 constantly, elimination of the downward pressure applied by the eccentric cam 142 to the pressing member 140 can switch the pressing member 140 from the pressing position to the retracted position reliably and prevent the pressing member 140 from returning to the pressing position naturally. According to this configuration, when the sheet member P is fed, the pressing member 140 is retained at the retracted position constantly and does not hinder the sheet feeding operation.

A timing to switch the pressing member 140 to the retracted position can be adjusted by a timing of rotation of the eccentric cam 142 when the motor 143 is driven. Specifically, the pressing member 140 can be switched to the retracted position according to paper types and conditions. For example, the switching timing of the pressing member 140 can be at the same time as or after the attraction/separation unit 130 separates from the sheet stack PA.

Figure 8A:
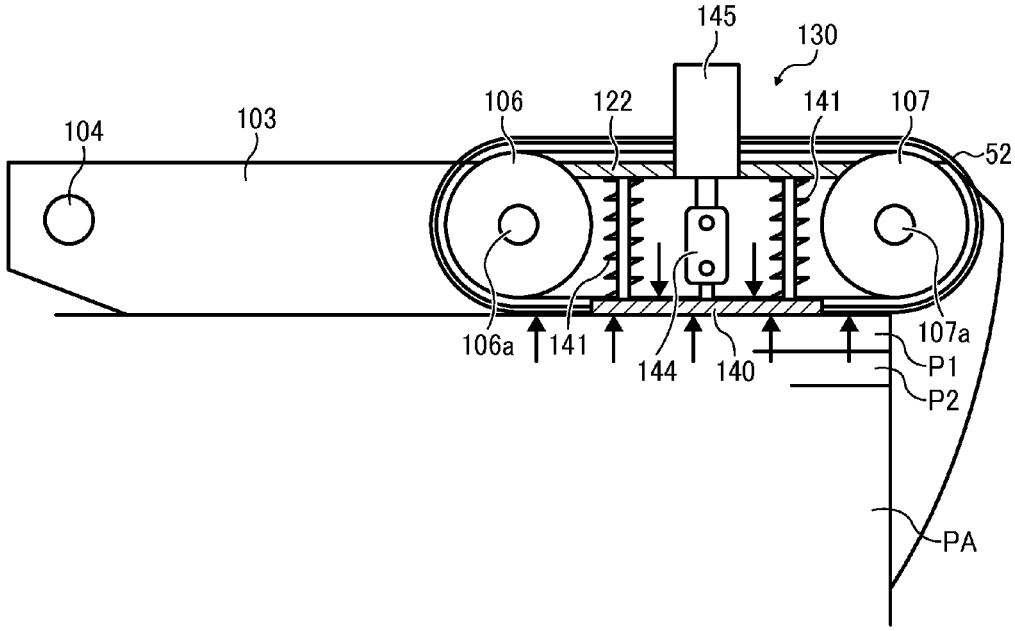
FIG. 8A is a diagram illustrating a schematic configuration of a sheet feeder according to another example of this disclosure with an attraction/separation unit at the sheet attraction position.
Figure 8B:
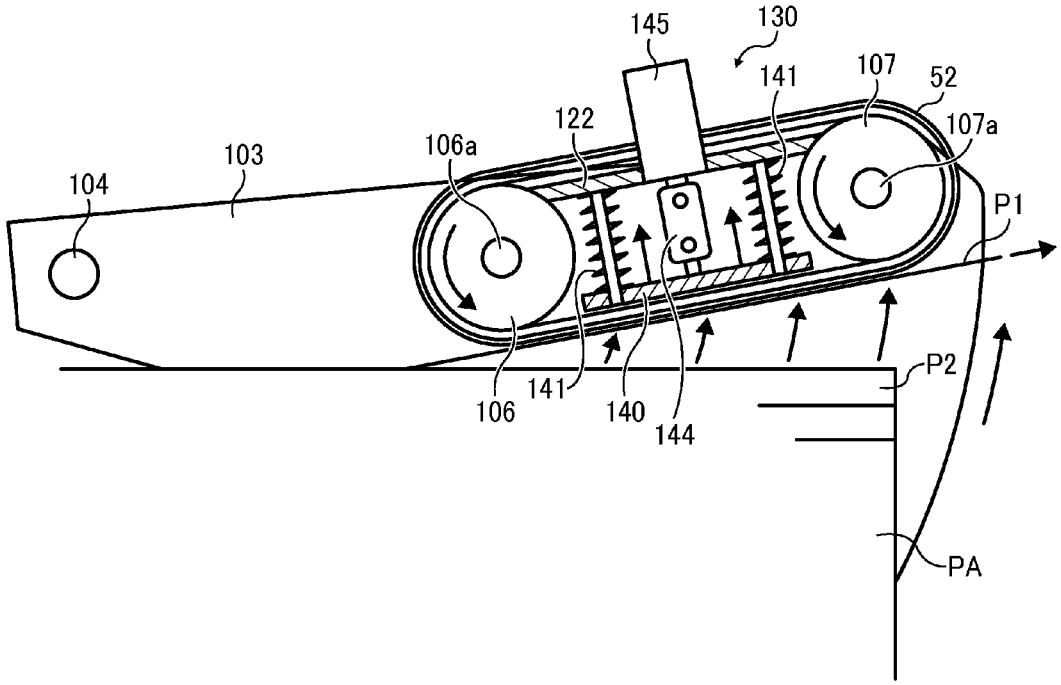
FIG. 8B is a diagram illustrating a schematic configuration of the sheet feeder of FIG. 8A with the attraction/separation unit at the sheet feeding position.

A description is given of a configuration of the sheet feeding device 5 according to another example of this disclosure with reference to FIGS. 8A and 8B.

FIG. 8A illustrates the sheet feeding device 5 according to this example with the attraction/separation unit 130 at the sheet attraction position. FIG. 8B illustrates the sheet feeding device 5 of the sheet feeder of FIG. 8A with the attraction/separation unit 130 at the sheet conveyance position.

The sheet feeding device 5 according to this example includes an actuator 145 and a link 144 instead of the motor 143 and the eccentric cam 142. The actuator 145 functions as a drive unit to apply a driving force and the link 144 functions as a linking member to move upward and downward.

The pressing member 140 is connected to the link 144, so that the driving force applied by the actuator 145 is transmitted from the link 144.

Similar to the example illustrated in FIGS. 6A through 7B, the pressing member 140 is biased by the elastic member 141 toward the upward direction. When no other force is applied, the pressing member 140 is retained at the retracted position as illustrated in FIG. 8B.

Transmission of the driving force of the actuator 145 via the link 144 to the pressing member 140 presses the pressing member 140 downwardly to move to the pressing position as illustrated in FIG. 8A. Thus, same as the example illustrated in FIGS. 6A through 7B, the pressing member 140 can be switched between the pressing position and the retracted position depending on whether the driving force applied by the actuator 145 is transmitted or not.

It is to be noted that, different from the example illustrated in FIGS. 6A through 7B and the example illustrated in FIGS. 8A and 8B, there is another configuration in which the elastic member 141 biases the pressing member 140 downwardly, so that the pressing member 140 is pressed upward by receiving a driving force applied by a driving unit.

Figure 9:
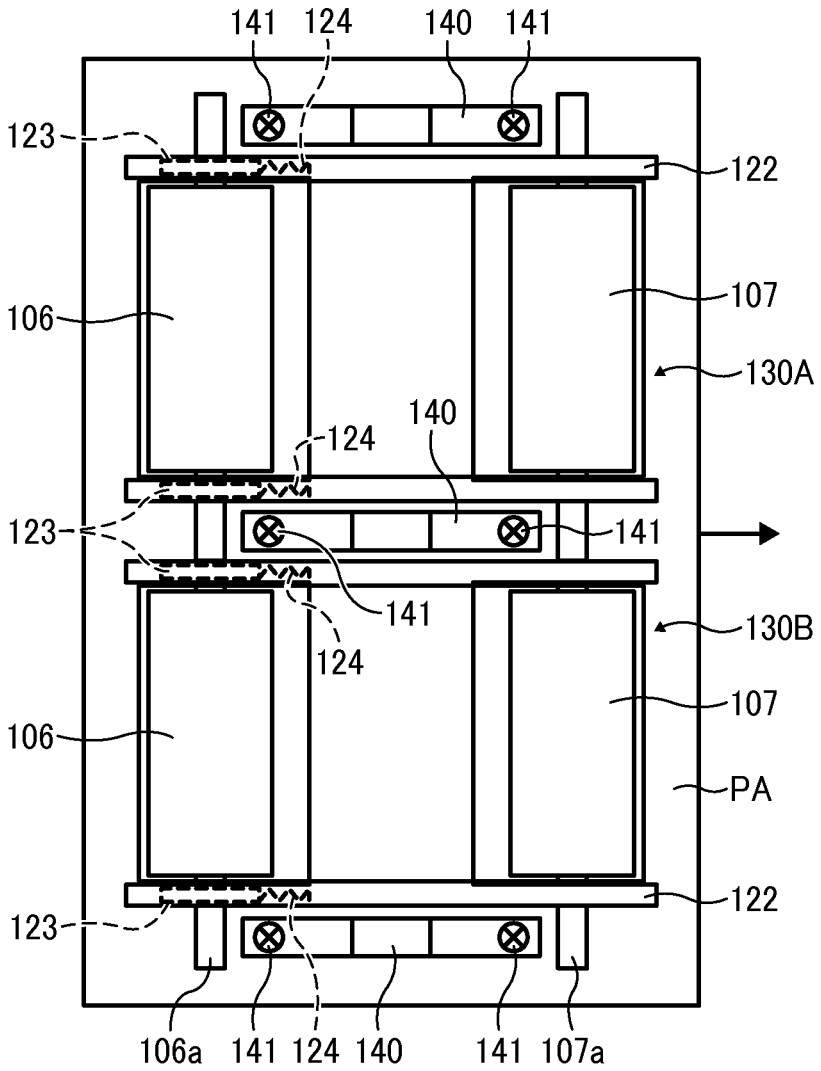
FIG. 9 is a top view illustrating a schematic configuration of a sheet feeder according to yet another example of this disclosure.

FIG. 9 is a top view illustrating a schematic configuration of the sheet feeding device 5 according to yet another example of this disclosure.

The sheet feeding device 5 according to this example includes an additional pressing member 140 and two attraction/separation units 130A and 130B. Specifically, the sheet feeding device 5 includes not only the two pressing members 140 disposed at both lateral ends or width ends of the sheet stack PA (upper and lower parts in FIG. 9) but also the additional pressing member 140 at a center in the width direction of the sheet stack PA and between the attraction/separation units 130A and 130B.

The sheet feeding device 5 as illustrated in FIG. 6A includes two pressing members 140 disposed facing the both lateral ends of the sheet stack PA. The sheet feeding device 5 according to this example illustrated in FIG. 9, however, includes one more pressing member 140 disposed at the center in the width direction of the sheet stack PA. By so doing, the sheet feeding device 5 according to this example can press both lateral ends and center of the uppermost sheet P1 placed on top of the sheet stack PA. As a result, the waves and/or curls of the sheet member P, i.e., the uppermost sheet P1 can be eliminated reliably. Further, since intervals between the pressing members 140 are reduced, the pressing members 140 can press smaller size sheets.

Other than the above-described configurations of the sheet feeding device 5, a single pressing member 140 may be used for multiple attraction/separation units 130. Further, more than four of the pressing members 140 may be provided or a single pressing member 140 may be used to press either one of both lateral ends of the sheet member P.

It is to be noted that an image forming apparatus of this disclosure is not limited to the color image forming apparatus 1 as illustrated in FIG. 1. For example, the image forming apparatus 1 can be a monochrome image forming apparatus and a copier, a printer, a facsimile machine, an offset printer, or multifunction peripheral printers having at least two of copying, printing, facsimile functions, offset printing functions, and the like.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet feeder comprising:

a sheet container;

a sheet conveying member disposed facing a sheet stack that includes multiple sheet members loaded on the sheet container to separate an uppermost sheet member placed on the sheet stack from the other sheet members and to convey the uppermost sheet member;

a pressing member switchable between a pressing position to press the sheet stack from above and a retracted position to separate from the sheet stack;

a drive unit; and a drive transmission unit to transmit a drive force applied by the drive unit, wherein the pressing member is switched between the pressing position and the retracted position by receiving transmission of the drive force of the drive unit from the drive transmission unit.

2. The sheet feeder according to claim 1, wherein the pressing member is disposed at a position outside a sheet conveying path in a width direction of the sheet conveying member.

3. The sheet feeder according to claim 1, wherein the drive unit is a motor and the drive transmission unit is an eccentric cam.

4. The sheet feeder according to claim 1, wherein the drive unit is an actuator and the drive transmission unit is a linking member.

5. The sheet feeder according to claim 1, further comprising a biasing member to bias the pressing member toward the retracted position.

6. The sheet feeder according to claim 5, wherein the biasing member is an elastic member.

7. The sheet feeder according to claim 1, wherein the sheet conveying member includes multiple sheet conveying members aligned along a direction perpendicular to a sheet conveying direction of the sheet member.

8. The sheet feeder according to claim 1, wherein the pressing member includes multiple pressing members aligned in a direction perpendicular to a sheet conveying direction of the sheet member.

9. The sheet feeder according to claim 1, further comprising a charger to charge the sheet conveying member.

10. An image forming apparatus comprising:

the sheet feeder according to claim 1; and an image forming part to form an image on the sheet member, wherein the image forming apparatus is one of a copier, a facsimile machine, a printer, an offset printing machine, or a multifunctional machine having at least two functions of the copier, the facsimile machine, the printer, and the offset printing machine.

11. A sheet feeder comprising:

a sheet container;

a sheet conveying member disposed facing a sheet stack that includes multiple sheet members loaded on the sheet container to separate an uppermost sheet member placed on the sheet stack from the other sheet members and to convey the uppermost sheet member;

a pressing member switchable between a pressing position to press the sheet stack from above and a retracted position to separate from the sheet stack; and a biasing member to bias the pressing member toward the retracted position.

12. The sheet feeder according to claim 11, wherein the pressing member is disposed at a position outside a sheet conveying path in a width direction of the sheet conveying member.

13. The sheet feeder according to claim 11, wherein the drive unit is a motor and the drive transmission unit is an eccentric cam.

14. The sheet feeder according to claim 11, wherein the drive unit is an actuator and the drive transmission unit is a linking member.

15. The sheet feeder according to claim 11, wherein the biasing member is an elastic member.

16. The sheet feeder according to claim 11, wherein the sheet conveying member includes multiple sheet conveying members aligned along a direction perpendicular to a sheet conveying direction of the sheet member.

17. The sheet feeder according to claim 11, wherein the pressing member includes multiple pressing members aligned in a direction perpendicular to a sheet conveying direction of the sheet member.

18. The sheet feeder according to claim 11, further comprising a charger to charge the sheet conveying member.

19. An image forming apparatus comprising:

the sheet feeder according to claim 11; and an image forming part to form an image on the sheet member, wherein the image forming apparatus is one of a copier, a facsimile machine, a printer, an offset printing machine, or a multifunctional machine having at least two functions of the copier, the facsimile machine, the printer, and the offset printing machine.

20. A sheet feeder comprising:

a sheet container;

a sheet conveying member disposed facing a sheet stack that includes multiple sheet members loaded on the sheet container to separate an uppermost sheet member placed on the sheet stack from the other sheet members and to convey the uppermost sheet member; and a pressing member switchable between a pressing position to press the sheet stack from above and a retracted position to separate from the sheet stack, wherein the pressing member is disposed at a position outside a sheet conveying path in a width direction of the sheet conveying member.

* * * * *